US010541122B2

(12) United States Patent
Blessing et al.

(10) Patent No.: US 10,541,122 B2
(45) Date of Patent: Jan. 21, 2020

(54) ROBUST ION SOURCE

(71) Applicant: MKS Instruments, Inc., Andover, MA (US)

(72) Inventors: James E. Blessing, Scotts Valley, CA (US); Jonathan Leslie, Altrincham (GB); Jonathan Hugh Batey, Frodsham (GB)

(73) Assignee: MKS Instruments, Inc., Andover, MA (US)

( * ) Notice: Subject to any disclaimer, the term of this patent is extended or adjusted under 35 U.S.C. 154(b) by 1 day.

(21) Appl. No.: 15/621,241

(22) Filed: Jun. 13, 2017

(65) Prior Publication Data

US 2018/0358217 A1 Dec. 13, 2018

(51) Int. Cl.
*H01J 49/14* (2006.01)
*H01J 49/08* (2006.01)

(52) U.S. Cl.
CPC ..... *H01J 49/147* (2013.01); *H01J 49/08* (2013.01)

(58) Field of Classification Search
USPC ..... 250/288, 423 R, 424, 427, 423 F
See application file for complete search history.

(56) References Cited

U.S. PATENT DOCUMENTS 2,938,116 A 5/1960 Benson et al.
3,505,518 A * 4/1970 Mitani ..... H01J 49/14 250/399
4,016,421 A * 4/1977 Hull ..... H01J 49/0422 250/281
4,039,828 A 8/1977 Pokar et al.
(Continued)

FOREIGN PATENT DOCUMENTS

EP 1364387 B1 1/2016
EP 3059756 A1 8/2016
WO 2012024468 A2 2/2012

OTHER PUBLICATIONS

Gardner, et al., "Infrared Multiphoton Dissociation of Peptide Cations in a Dual Pressure Linear Ion Trap Mass Spectrometer", Dept. of Chemistry and Biochemistry, The University of Texas at Austin, Anal. Chem., 2009, 81 (19), pp. 8109-8118.
(Continued)

*Primary Examiner* — Kiet T Nguyen
(74) *Attorney, Agent, or Firm* — Hamilton, Brook, Smith & Reynolds, P.C.

(57) ABSTRACT

Apparatus (e.g., ion source), systems (e.g., residual gas analyzer), and methods provide extended life and improved analytical stability of mass spectrometers in the presence of contamination gases while achieving substantial preferential ionization of sampled gases over internal background gases. One embodiment is an ion source that includes a gas source, nozzle, electron source, and electrodes. The gas source delivers gas via the nozzle to an evacuated ionization volume and is at a higher pressure than that of the evacuated ionization volume. Gas passing through the nozzle freely expands in an ionization region of the ionization volume. The electron source emits electrons through the expanding gas in the ionization region to ionize at least a portion of the expanding gas. The electrodes create electrical fields for ion flow from the ionization region to a mass filter and are located at distances from the nozzle and oriented to limit their exposure to the gas.

33 Claims, 7 Drawing Sheets

(56) References Cited

U.S. PATENT DOCUMENTS

| | | | | |
|---|---|---|---|---|
| 4,166,952 | A * | 9/1979 | Colby | H01J 49/142 250/288 |
| 4,433,241 | A | 2/1984 | Boesl et al. | |
| 4,960,991 | A * | 10/1990 | Goodley | H01J 27/08 250/281 |
| 6,777,671 | B2 | 8/2004 | Doroshenko | |
| 6,794,644 | B2 | 9/2004 | Park | |
| 7,034,292 | B1 | 4/2006 | Whitehouse et al. | |
| 7,091,477 | B2 | 8/2006 | Jolliffe et al. | |
| 7,495,212 | B2 | 2/2009 | Kim et al. | |
| 7,750,312 | B2 | 7/2010 | Corr et al. | |
| 8,084,736 | B2 | 12/2011 | Schneider et al. | |
| 8,232,520 | B2 | 7/2012 | Cristoni | |
| 8,296,090 | B2 | 10/2012 | Aoki et al. | |
| 8,450,681 | B2 | 5/2013 | Shaw et al. | |
| 8,536,518 | B2 | 9/2013 | Kozole | |
| 8,642,946 | B2 | 2/2014 | Splendore et al. | |
| 8,642,949 | B2 | 2/2014 | Makarov et al. | |
| 8,953,145 | B2 | 2/2015 | Kraus et al. | |
| 8,969,795 | B2 | 3/2015 | Wollnik et al. | |
| 9,006,679 | B2 | 4/2015 | Morokuma et al. | |
| 9,305,759 | B2 | 4/2016 | McEwen et al. | |
| 9,305,762 | B2 | 4/2016 | Covey et al. | |
| 9,343,280 | B2 | 5/2016 | Cousins et al. | |
| 9,502,226 | B2 | 11/2016 | Brown et al. | |
| 9,552,973 | B2 | 1/2017 | McEwen et al. | |
| 2004/0026614 | A1 | 2/2004 | Bateman et al. | |
| 2014/0374589 | A1 | 12/2014 | Javaheri et al. | |
| 2015/0144779 | A1* | 5/2015 | Verenchikov | H01J 49/147 250/282 |
| 2016/0163528 | A1 | 6/2016 | Splendore et al. | |
| 2016/0247669 | A1* | 8/2016 | Tateishi | H01J 27/024 |
| 2016/0293392 | A1 | 10/2016 | Berkout | |

OTHER PUBLICATIONS

Neidholdt, et al., "Compact Ambient Pressure Pyroelectric Ion Source for Mass Spectrometry", Arthur Amos Noyes Laboratory of Chemical Physics and the Beckman Institute, Anal. Chem., 2007, 79 (10), pp. 3945-3948.

Ionoptika, Ion Beam Technology "IOG C60-10 Ion Beam System", 2015, pp. 1-3, http://www.ionoptika.com/products/products/ion-beams/c60/iog-c60-10-ion-beam-system.

The University of Manchester, School of Chemistry, "Commercialisation of a 'gentle' ion beam—new analysis for biolabs", pp. 1-4, retrieved Jun. 29, 2017. http://www.chemistry.manchester.ac.uk/our-research/research-impact/sims/.

XPS Technical Bulletin, "PHI Model 06-C60 Sputter Ion Gun", 2011, Physical Electronics USA, Inc., pp. 1-12.

International Search Report and Written Opinion for International Application No. PCT/US2018/036523, entitled "Robust Ion Source", dated Aug. 27, 2018.

Helm et al., "Electron-impact ionization of Ar2, ArKr, Kr2, KrXe and Xe2", Physical Review A, American Physical Society, vol. 19, No. 6, Jun. 1, 1979, pp. 2154-2160.

Crawford, "Mass Spectrometer Ion Source for Ionication Cross-Section Measurement", Journal of Vacuum Science and Technology, No. 5, No. 5, Sep. 1, 1968, pp. 131-140.

Hendricks et al., "Anion solvation at the microscopic level: Photoelectron spectroscopy of the solvated anion clusters, N0-(Y)n, where Y=Ar, Kr, Xe, N20, H2S, NH3, H20, and C2H4(0H)2", Journal of Chemical Physics, vol. 116, No. 18, May 8, 2002, pp. 7926-1938.

* cited by examiner

ROBUST ION SOURCE

BACKGROUND

A mass spectrometer measures the masses within a molecular sample to analyze the composition of the sample. A residual gas analyzer (RGA) is a relatively small mass spectrometer that measures the composition of a gas by ionizing components of the gas to create a charge, and determining the mass-to-charge ratios of those components. RGAs are commonly used to check for gas composition and contamination, and may operate in an evacuated environment at lower pressure than the source of the gas being analyzed. The main components of a residual gas analyzer are an ion source, mass analyzer (mass filter), detector and associated electronics. The ion source ionizes molecules of the gas, the mass analyzer selects the ions by their mass-to-charge ratio, and the detector determines the amounts of the selected ions.

RGA ion sources are generally one of two types: open or closed. An open ion source is usually mounted in a vacuum chamber with its components exposed to sample gas from a process environment, directly. The sample gas molecules in the vacuum chamber can move through the ion source from many directions—there is no pressure difference within the ion source and around it. When the pressure of the gases is too high for the RGA to operate properly, a pressure-reducing gas-sampling vacuum system is used to bring a sample of the gas to be analyzed down to an acceptable pressure. In such applications, an open ion source suffers from drawbacks, such as interference from the gases in the residual vacuum of the sampling system (e.g., hydrogen, water, carbon monoxide, oils).

A closed ion source is preferred, generally, when using an RGA to analyze gas with a pressure-reducing gas-sampling system. A closed ion source provides an ionization chamber operated at, or below the pressure of the sample gas, but higher than can be tolerated by the whole RGA. This chamber has restricted gas exit conductance with only small openings for entrance and exit of gases, electrons, and ions. Electrons are directed into the chamber to form ions of the sample gas at the relatively high pressure in the chamber. The sample gas is at higher pressure than could be tolerated with an open ion source, so the signal from the sample gas is correspondingly higher than the signal from the residual vacuum of the pressure reducing system, providing a higher fidelity analysis of the sample gas. Because critical electrode surfaces of the closed ion source are exposed to the sample gas at a higher pressure than an open ion source, the closed ion source is susceptible to degradation much faster because the sample gas can contaminate those surfaces. Additionally, the electron source is typically located close to the hole where electrons are introduced into the ionization chamber, and is thus exposed to the sample gas at a pressure much higher than the average pressure of the mass spectrometer. Thus, closed ion sources have higher analytical fidelity but are susceptible to higher degradation rates, while open ion sources have lower degradation rates but provide lower analytical fidelity.

Prior approaches to this degradation problem used in other (non RGA) systems include cross beam ionizers and dynamically adjusted ion sources with extra control surfaces. However, extra control surfaces increase cost and complexity, often require frequent adjustment procedures, and have limited effectiveness with extreme contamination. Cross beam ion sources have low sensitivity for the amount of gas consumed as they analyze a collimated gas stream from a small portion of the sampled gas using multistage pumping systems to strip off a majority of the sampled gas. This results in either a small sample gas signal, or the need for large, expensive pumping systems that consume high flows of sample gas.

SUMMARY

The disclosed embodiments provide good sample gas analysis fidelity with extended life and improved analytical stability of mass spectrometers in the presence of contaminating gases. One example embodiment is an ion source that includes a gas source, nozzle, electron source, and electrodes. As used herein, the term nozzle means a gas flow delivering element with a relatively small outlet. The nozzle may be a tube or similar structure of any length, even zero. If the length of the nozzle is zero, then the nozzle can be in the form of an aperture in a surface. The gas source delivers gas through the nozzle to an evacuated ionization volume, and is at a substantially higher pressure than that of the evacuated ionization volume. Gas passing from the source through the nozzle freely expands in an ionization region of the ionization volume, the gas pressure quickly decreasing as the gas expands away from the outlet of the nozzle. The electron source emits electrons that pass close to the nozzle through the expanding gas in the ionization region to ionize at least a portion of the expanding gas. The electrodes create electrical fields for ion flow from the ionization region to a mass filter of a mass spectrometer and are located at distances from and, orientations to, the nozzle to limit direct exposure of the electrodes to the gas.

Another example embodiment is a mass spectrometer system that includes a vacuum pump, mass filter, detector, and ion source. The ion source includes a gas source, nozzle, electron source, and electrodes, as described above, where the electrodes of the ion source create electrical fields for ion flow from the ionization region to the mass filter. The nozzle of the ion source may be oriented to direct the gas from the gas source toward the vacuum pump.

In many embodiments, at least 20% of the gas molecules from the nozzle pass through the ionization region. In some embodiments, the electron source can be a heated filament. In such (or other) embodiments, the electron source can be arranged on an opposite side, with respect to the ionization region, of a first electrode. In such embodiments, electrons produced by the electron source travel through an aperture of the first electrode and toward the ionization region, resulting in an electron beam traveling through the expanding gas in the ionization region. In such embodiments, a second electrode can be arranged opposite the first electrode. The second electrode can include an aperture. Electrons travel through the ionization region and toward the second electrode, many of which may travel through the aperture, if included.

A trap electrode may be arranged opposite the first electrode with respect to the ionization region, and can measure at least a portion of the electron beam current flowing through the ionization region. In embodiments including the second electrode with aperture, the trap electrode can be arranged outside the second electrode with respect to the ionization region. A second electron source, which in some embodiments may be configured to function as a trap electrode, can be arranged outside the aperture in the second electrode. In some embodiments, the first electron source may be used as a trap electrode, for example, when operating a second electron source.

In many embodiments, the electrodes include first and second electrodes arranged on opposite sides of the ionization region, where the surfaces of the first and second electrodes are substantially parallel to a primary direction of gas flow from the nozzle through the ionization region. In such (or other) embodiments, a repelling electrode may repel ions from the ionization region toward the mass filter, and in such (or other) embodiments, an ion exit electrode having an aperture may direct the ion flow from the ionization region to the mass filter. The voltages applied to the various electrodes may be independently controllable.

In some embodiments, the outlet opening of the nozzle may have an area of five square millimeters or less. The area of the outlet opening of the nozzle can relate inversely to the pressure of the gas source for a desired gas flow, such that the area of the outlet opening of the nozzle can be much smaller if the gas source pressure is very high. In such (or other) embodiments, the cross-sectional area of the electron beam at the ionization region may be twenty square millimeters or less. In such (or other) embodiments, the electrodes may be located at least five millimeters from the nozzle center.

Another example embodiment is a method of producing ions for a mass spectrometer having a mass filter. The method includes delivering gas from a gas source to an evacuated ionization volume through a nozzle. The gas source is at a substantially higher pressure than that of the evacuated ionization volume, and gas passing through nozzle freely expands in an ionization region of the ionization volume. The method further includes emitting electrons close to the nozzle and through the expanding gas in the ionization region to ionize at least a portion of the expanding gas, and directing ions formed in the ionization region to the mass filter.

In some embodiments, directing the ions can be accomplished using electric fields created by electrodes, in which case delivering the gas to the evacuated ionization volume includes delivering the gas at distances from the electrodes to limit direct exposure of the electrodes to the gas. In such (or other) embodiments, directing the ions can include repelling the ions from the ionization region toward the mass filter and can include focusing the ions from the ionization region through an aperture to the mass filter. In such (or other) embodiments, emitting the electrons can include emitting electrons from a heated filament, and can include emitting electrons through an aperture of a first electrode on one side of the ionization region, through the expanding gas in the ionization region, and through an aperture of a second electrode on an opposite side of the ionization region.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The disclosed apparatus (e.g., ion source), systems (e.g., residual gas analyzer), and methods provide extended life and improved analytical stability in the presence of contaminating gases, especially gases that deposit surface coatings, while achieving substantial preferential ionization of sampled gases over internal background gases. The disclosed apparatus, systems, and methods provide performance like a closed ion source, but without the short lifetime and unstable gas species sensitivities due to ion source contamination and surface charging. Thus, improved service intervals and operating costs and improved results without excessive recalibration are achieved.

According to an example embodiment, sample gas is introduced directly into an ionizer region of a mass spectrometer (e.g., residual gas analyzer) in its vacuum chamber via a nozzle, such as, for example, a small diameter tube, the length of which can be from arbitrarily long to zero (an aperture). The sample gas freely expands into the vacuum chamber. The tip of the nozzle is positioned close (e.g., adjacent or near adjacent), to an electron beam, where ions of the sample gas are formed near an entrance aperture of a mass filter (e.g., quadrupole). The end of the nozzle can be relatively small to limit interaction with the electron beam. Critical ionizer electrode surfaces are not directly in the dominant path of the expanding gas; thus, there is minimal exposure of those surfaces to the gas and any contaminants it might contain. Any surfaces that do receive direct gas exposure are sufficiently off axis of the gas path and/or relatively far from the point of the gas expansion such that the density of the gas at these surfaces is less than, for example, 1/30th the density of the gas when in the nozzle. This reduces the rate of any surface film formation and any subsequent surface charging that can degrade effectiveness of the ion source. To further reduce the amount of sample gas that reaches any critical surfaces, the sample gas can be introduced in a direction toward the chamber's vacuum pump.

Figure 1:
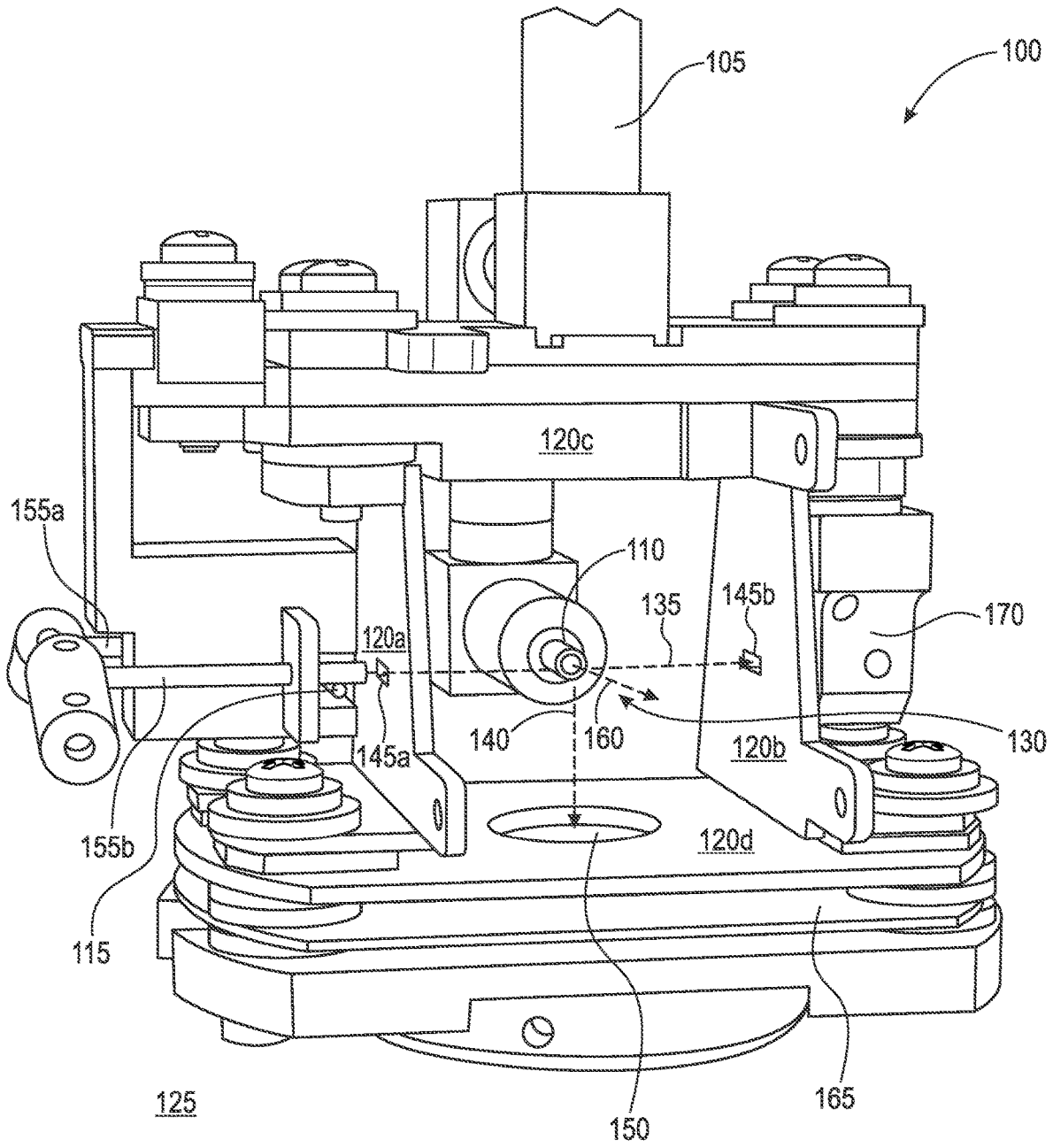
FIG. 1 is a perspective drawing of an ion source for a mass spectrometer, according to an example embodiment.

FIG. 1 is a perspective drawing of an ion source 100 for a mass spectrometer, according to an example embodiment. The example ion source 100 includes a gas source 105, nozzle 110, electron source 115, and electrodes 120*a-d*. The nozzle 110 may also itself be an electrode. The gas source 105 delivers gas to an evacuated ionization volume 125 and is at a higher pressure than that of the evacuated ionization volume 125. The nozzle 110 is between the gas source 105 and the ionization volume 125. Gas passing through the nozzle 110 freely expands in an ionization region 130 of the ionization volume 125. The electron source 115 emits electrons 135 through the expanding gas in the ionization region 130 (near the end of the nozzle) to ionize at least a portion of the expanding gas. The electrodes 120*a-d*, and optionally the nozzle 110, create electrical fields that determine the energy of the ions formed and provide for extraction of the ions (ion flow 140) from the ionization region 130 to a mass filter (not shown in FIG. 1). The electrodes 120*a-d* are located away from the primary path of expanding gas and at distances from the nozzle 110 to limit direct contact of the electrodes 120*a-d* with the expanding gas. A trap electrode 170, arranged on the other side of electrode 120*b*, can measure the electron beam current 135 flowing through the aperture 145*b* of the second electrode 120*b*.

In the example ion source 100, the electron source 115 is a heated filament located outside of the ionization region 130 on the other side of electrode 120*a* and connected to electric leads 155*a,b*. The filament may be straight as shown, coiled, or have other forms as appropriate for the desired electron focusing. Electrons 135 produced by the filament 115 travel through an aperture 145*a* in electrode 120*a*, through the ionization region 130, and onto electrode 120*b*, as well as through aperture 145*b* in electrode 120*b*, on the other side of the ionization region 130. Electrodes 120*a* and 120*b* are arranged so that their surfaces are substantially parallel to a primary direction of gas flow 160 from the nozzle through the ionization region, which reduces the amount of gas that may be deposited on the electrodes 120*a,b*. While the primary direction of gas flow 160 is illustrated in FIG. 1, it should be understood that the flow of gas is a distribution (e.g., a cosine distribution) due to the expanding nature of the gas, with the majority traveling in the direction of 160 and decreasing amounts to the sides, approaching zero flow directly to the sides towards 145*a* and 145*b*. The example ion source 100 also includes a repelling electrode 120*c* that repels ions from the ionization region toward the mass filter through an aperture 150 in an opposite, ion exit electrode 120*d*. With electrode 120*d* and aperture 150, electrode 165 focuses and extracts the ions through aperture 150 and transmits them to the mass filter through aperture 175.

The voltages applied to electrodes 120*a-d*, 165, 170 and the nozzle 110 can be independently controlled to tune the performance of the ion source. The following describes example values and ranges of values for various components of the ion source 100. Electrode 120*a* (electron entrance) can have a voltage of +10V (within an example range of −20V to +25V). Electrode 120*b* (electron exit) can have a voltage of +10V (within an example range of 0V to +25V). The repelling electrode 120*c* can have a voltage of +12 V (within an example range of +5 V to +30V). The ion exit electrode 120*d* can have a voltage of +10V (within an example range of 0V to +25V). The nozzle 110 can have a voltage of +6V (within an example range of 1V to +20V). The extract lens electrode 165 can have a voltage of −37V (within an example range of −20V to −90V). The trap electrode 170 can have a voltage of +10V (within an example range of −110V to +30V). The filament 115 can have a voltage of −60V (within an example range of −10V to −110V), resulting in an example electron current 135 of 0.5 mA (within an example range of 0.005 mA to 3 mA). These example values and ranges are provided for illustrative purposes only, and not in a limiting fashion.

Figure 2:
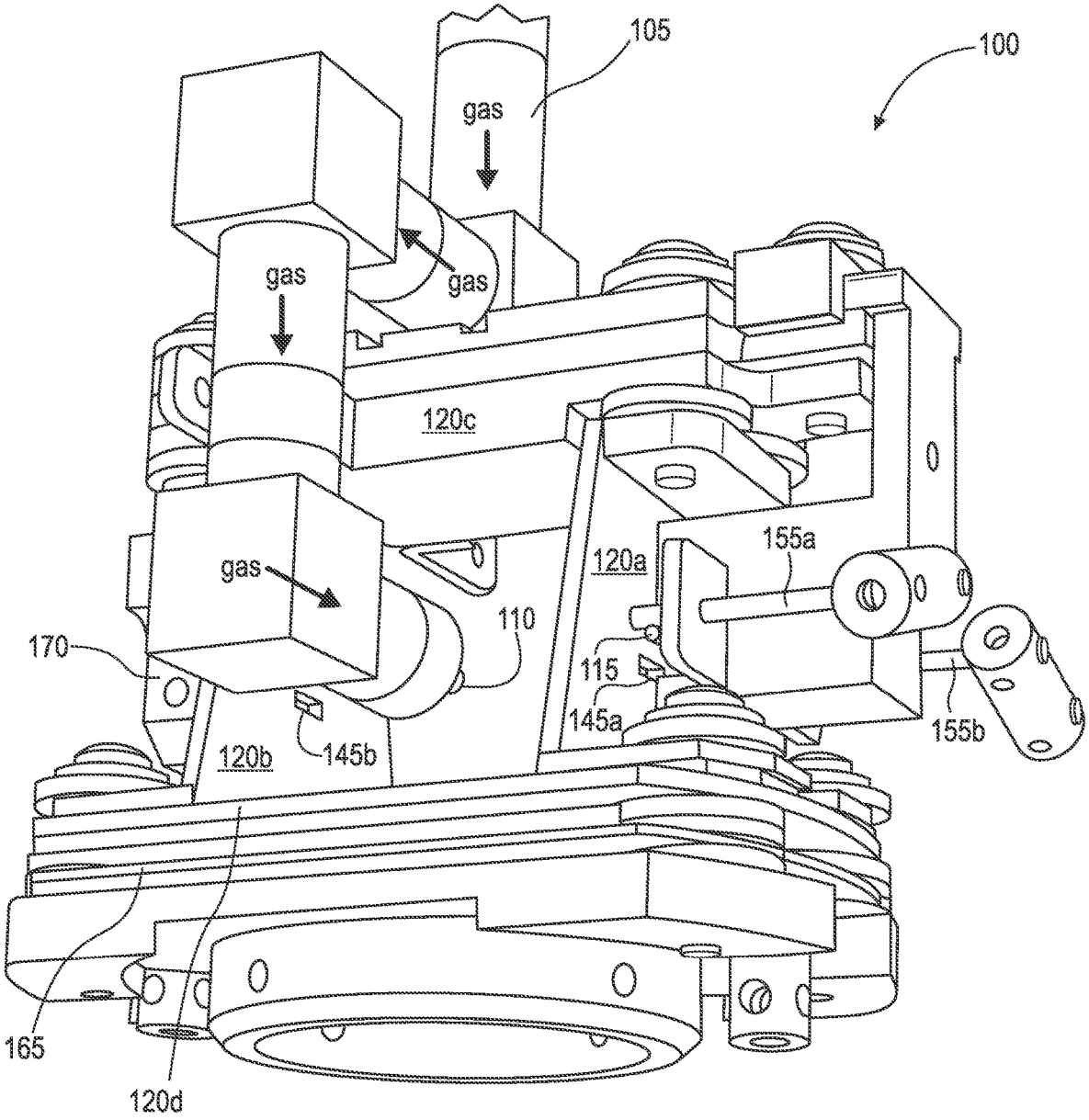
FIG. 2 is another perspective drawing of the example ion source of FIG. 1.

FIG. 2 is another perspective drawing of the example ion source 100 of FIG. 1. The perspective of FIG. 2 is about 180 degrees around the ion source 100 compared to FIG. 1. FIG. 2 shows the configuration of the gas source 105 and the flow of sample gas through the gas source 105, according to the example ion source 100. It should be appreciated that the gas source can be configured differently.

Figure 3:
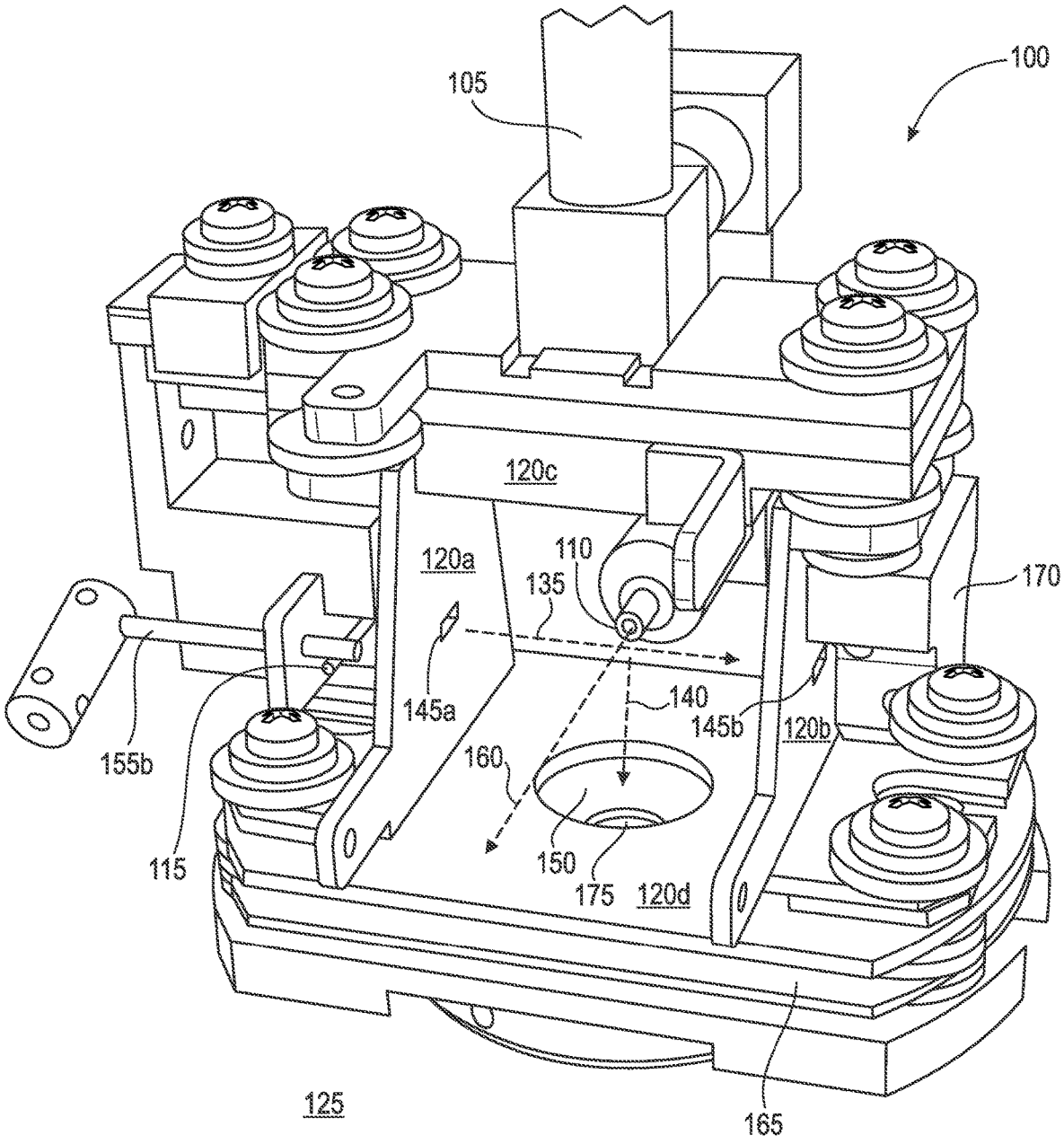
FIG. 3 is another perspective drawing of the example ion source of FIG. 1.

FIG. 3 is another perspective drawing of the example ion source 100 of FIG. 1. The perspective of FIG. 3 from a higher angle compared to FIG. 1 and provides another view of the ion exit aperture 150. As shown in the particular embodiment of the example ion source 100, there may be additional components (e.g., an extract lens 165 and aperture 175) beyond the ion exit electrode 120*d*.

Figure 4:
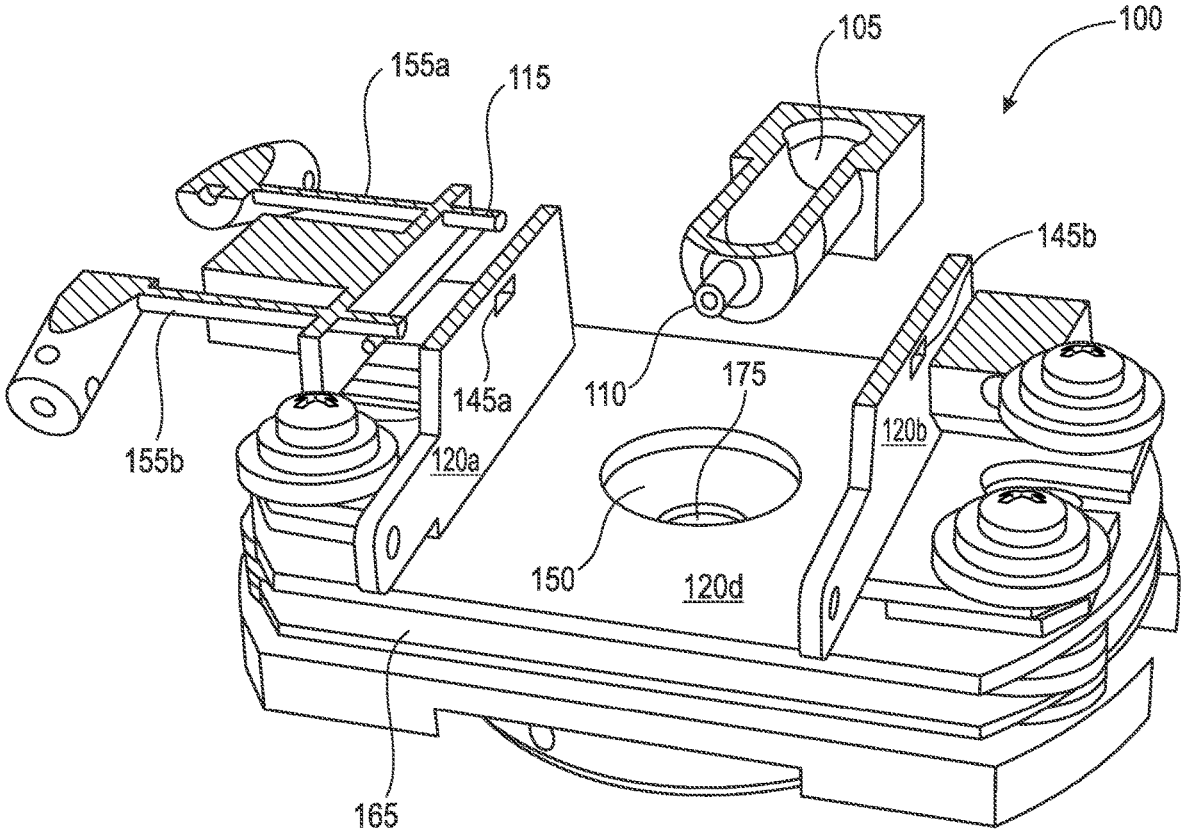
FIG. 4 is a cross-sectional perspective drawing of the example ion source of FIG. 1.

FIG. 4 is a cross-sectional perspective drawing of the example ion source 100 of FIG. 1. The perspective of FIG. 4 is similar to that of FIG. 3 and is cut open to provide another view of the filament 115 and the inside of the gas source 105.

Figure 5:
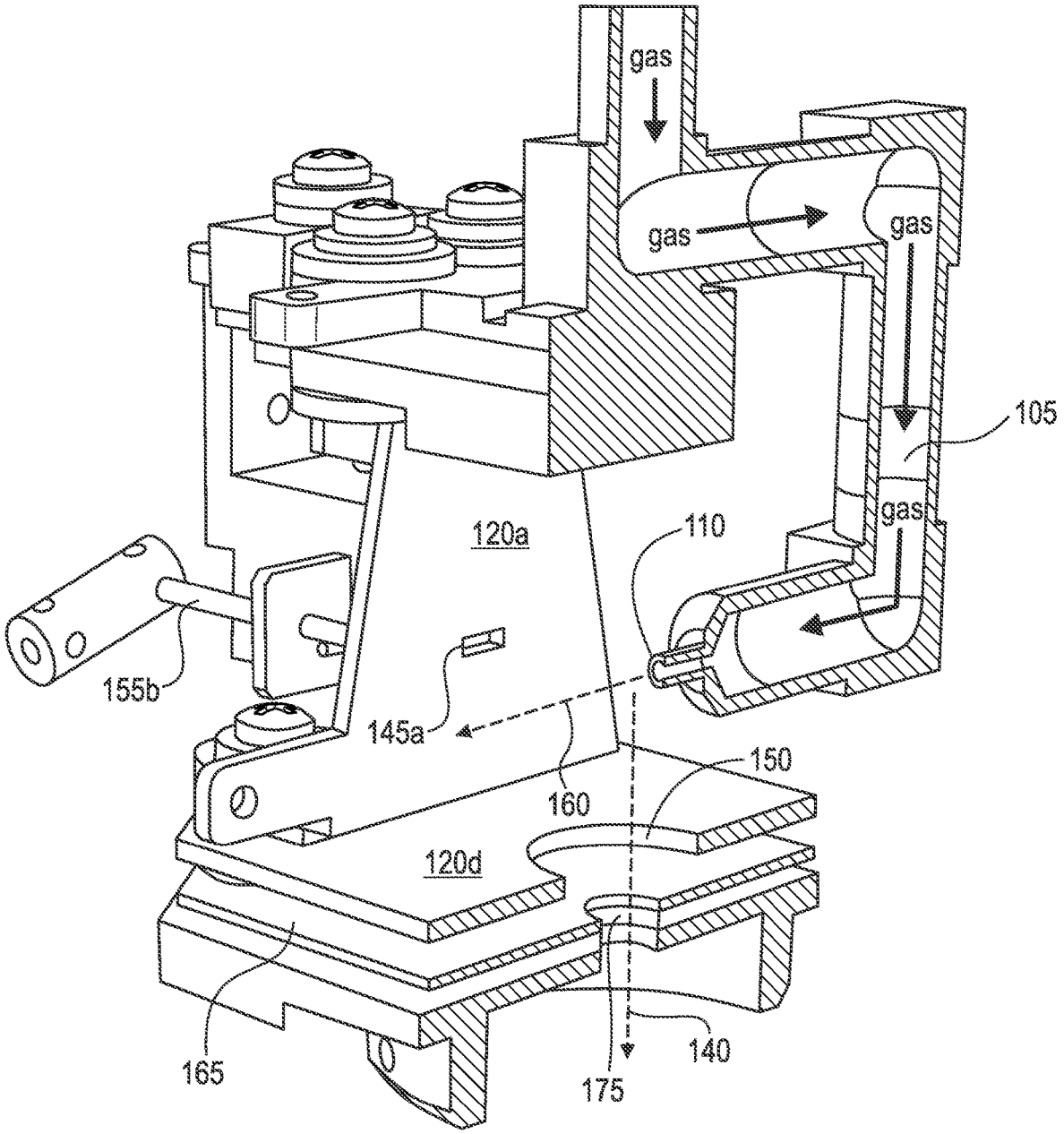
FIG. 5 is another cross-sectional perspective drawing of the example ion source of FIG. 1.

FIG. 5 is another cross-sectional perspective drawing of the example ion source 100 of FIG. 1. FIG. 5 is cut open to provide another view of the ion exit aperture 150, additional focusing electrode components 165, and the inside of the gas source 105 of the example ion source 100.

Figure 6:
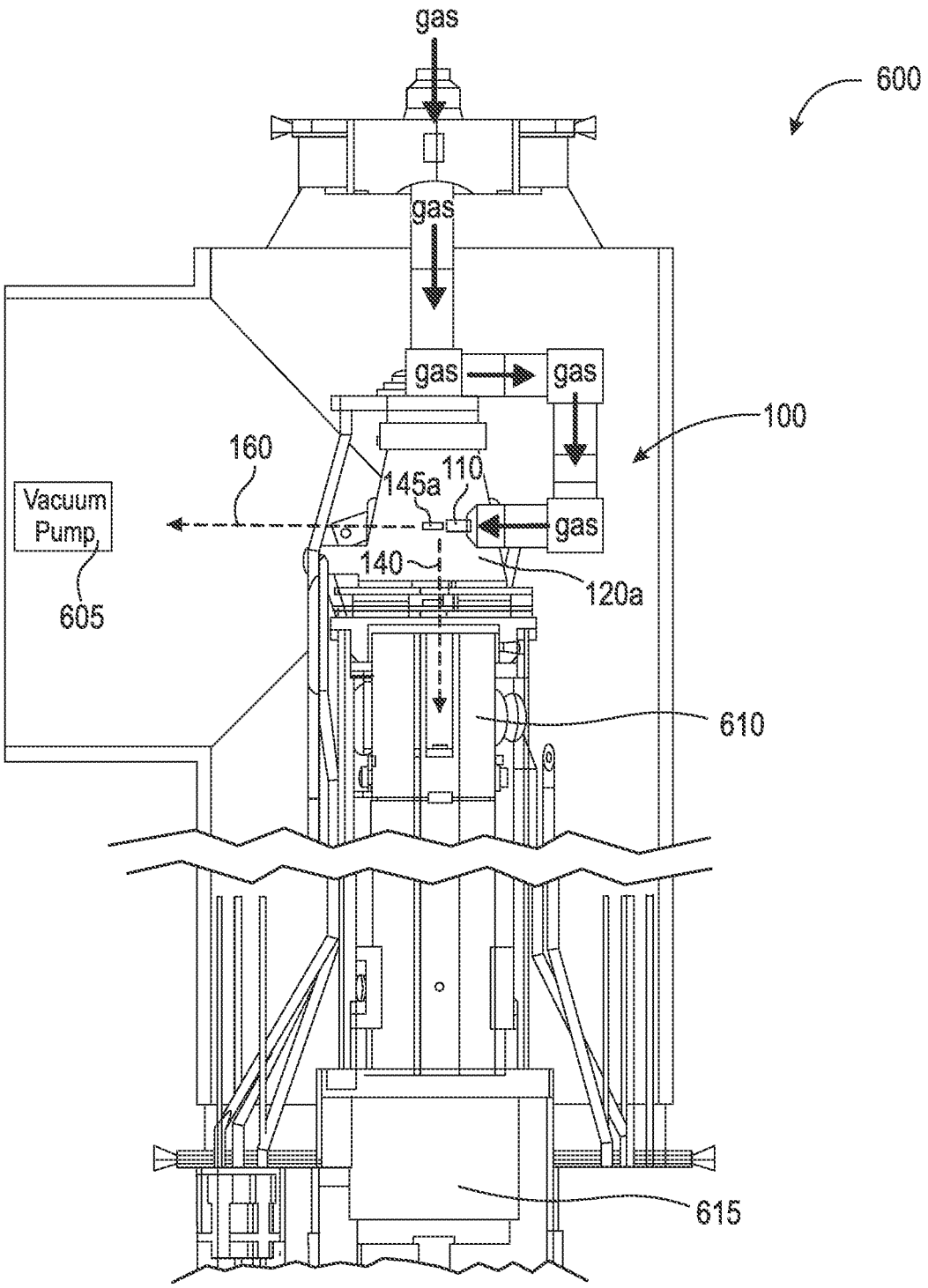
FIG. 6 is a schematic drawing of a mass spectrometer system, according to an example embodiment.

FIG. 6 is a schematic drawing of a mass spectrometer system 600, according to an example embodiment. The mass spectrometer system 600 includes a vacuum pump 605, mass filter 610, detector 615, and ion source (e.g., the ion source 100 illustrated in FIGS. 1-5). The ion source 100 produces ions from a sample gas, and the ions flow 140 from the ion source 100 to the mass filter 610. In the example mass spectrometer system 600, the nozzle 110 of the ion source directs the gas flow 160 toward the vacuum pump 605.

Figure 7:
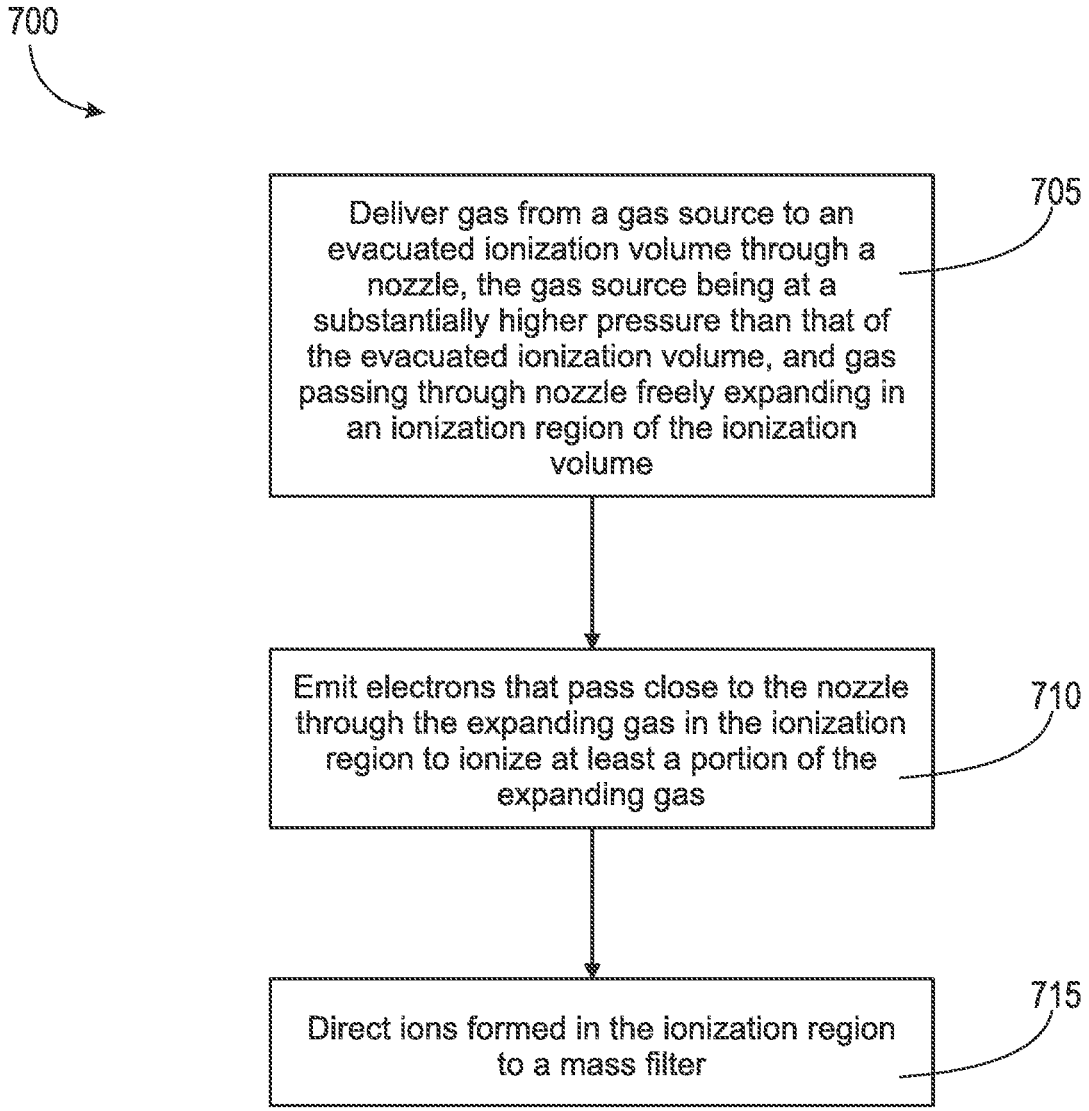
FIG. 7 is a flow diagram illustrating a method of producing ions for a mass spectrometer, according to an example embodiment.

FIG. 7 is a flow diagram illustrating a method 700 of producing ions for a mass spectrometer, according to an example embodiment. The example method 700 includes delivering 705 gas from a gas source to an evacuated ionization volume. The gas source is at a higher pressure than that of the evacuated ionization volume, and gas entering the ionization volume freely expands in an ionization region of the ionization volume. The method 700 further includes emitting 710 electrons through the expanding gas in the ionization region to ionize at least a portion of the expanding gas, and directing 715 ions formed in the ionization region to a mass filter. Directing 715 the ions can be accomplished using electric fields created by electrodes, in which case delivering 705 the gas to the evacuated ionization volume includes delivering the gas at distances from the electrodes to limit direct exposure of the electrodes to the gas. Directing 715 the ions can include repelling the ions from the ionization region toward the mass filter and can include focusing the ions from the ionization region through an aperture to the mass filter. Emitting 710 the electrons can include emitting electrons from a heated filament, and can include emitting electrons through an aperture of a first electrode on one side of the ionization region, through the expanding gas in the ionization region, and through an aperture of a second electrode on an opposite side of the ionization region.

The ionization region can be considered a volume where the electrons pass through the sample gas that is freely expanding into the ionization volume, unconstrained by electrodes or other structures, and from which the generated ions are directed into the mass filter. Thus the shape of the ionization region is substantially defined in two dimensions by the cross-sectional height and width of the electron beam. In the third dimension, along a length of the electron beam, the ionization region can be limited by action of the focusing electric field around the nozzle, created by the electrodes, such that only those ions formed near the nozzle are transmitted efficiently through apertures 150 and 175. Electrons will encounter and ionize gas outside of the region determined by the electrodes, but the resultant ions are from lower density gas and not wanted in the mass filter. In one embodiment, the concentration of sample gas is at least two (preferably more) times that of the average concentration of all gases outside of the ionization region.

The ion source can be optimized for ionization of a sample gas as it flows into an ionization volume from a pressure (typically greater than 1E-4 Torr) that is higher than that in the ionization volume (typically less than 2E-5 Torr). In general, pressure in the ionization volume will be less than ⅕th of the pressure at the outlet of the nozzle, and preferably much less, for example less than 1/100th of the of the pressure at the outlet of the nozzle. The ion source can optimize ion formation in, and ion extraction from, the relatively small ionization region where the electron beam passes through the sample gas as it is expanding freely from, and close to, an aperture (nozzle) delivering the higher pressure sample gas to the ionization region of the ionization volume. It is preferred that the electron beam pass as close as reasonable to the nozzle without contacting the nozzle. With the closest edge of the ionization region being very close to the nozzle, preferably within five millimeters and more preferably closer than a millimeter for example, volumetric density of sample gas in the ionization region is higher than the average pressure in the ionization volume, and should generally be at least two times higher, and preferably greater than ten times or more in many circumstances, thereby creating more ions of sample gas molecules in the ionization region versus ionization of gas molecules in other areas of the ionization volume. The critical surfaces (e.g., electrodes) of the ion source that define the voltage fields for ion formation and extraction can be deployed off of the main axis of gas expansion, thereby reducing direct exposure to the sample gas. Minimizing such direct contact with the majority of the expanding sample gas reduces electrode contamination from the sample gas that can degrade ion source performance over time. This configuration also provides an ion stream for mass spectrometry that is predominately from the sampled gas, before it has interacted with any ion source surface, and has, therefore, little change due to surface reactions. Furthermore, as the sample gas is freely expanding from higher to lower pressure, there is minimal formation of ion-molecule species that would occur with ionization at higher pressure, such as, for example, in a conductance-limited ionization chamber. Therefore, a significant benefit of the disclosed ion source is the production of an ion stream that represents the sample gas with high fidelity, while minimizing performance degradation due to contamination from the sample gas. This is valuable for analyzing gases that are labile and that can form deposits on ion source surfaces.

Unlike a traditional open ion source, the beam of electrons provides ionization in a relatively small, select volume at the point of sample gas introduction. The disclosed ion source differs from traditional open ion sources, which are designed for ion formation and extraction from all gas in the ion source without preference for sample gas from a higher pressure before it has interacted with surfaces in the ion source. Operating at low pressure, a traditional open ion source can have a relatively low rate of degradation from sample interaction, but provides an ion stream with relatively low fidelity for the sample gas.

Unlike a closed ion source, the amount of sample gas that reaches critical surfaces is greatly reduced. A closed ion source has an ionization chamber with restricted exit conductance to hold the sample gas at a pressure higher than the average pressure in the mass spectrometer system. The disclosed ion source differs from closed ion sources, which are optimized for ion formation and extraction from sample gas at high pressure in a relatively closed volume, not freely expanding, and with a high degree of interaction with the ion source surfaces as well as ion-molecule formation. The disclosed ion source does not have a restricted-conductance ionization chamber to hold the sample gas at an elevated pressure, instead allowing the sample gas to expand, unrestricted. The ion stream from a closed ion source can provide a higher fidelity representation of the sample gas than that from an open ion source, but a closed ion source is susceptible to higher rates of degradation from sample gas interactions.

Unlike a cross-beam ion source, the entire sample gas flow is admitted through a nozzle for ionization in a higher pressure, free expanding region through which an electron beam passes close to the nozzle. This ion source differs from a cross-beam ion source, which ionizes from a collimated portion of a sample gas stream that is located far from a nozzle and higher gas pressure region, and which requires additional stages of pumping and collimation. The ion stream from a cross-beam ion source can have good sample gas fidelity and reduced surface contamination, but only as part of a larger, more complex analysis system with high gas pumping speeds. In contrast, the disclosed ion source uses a large portion of a much smaller flow of sample gas without the need for collimation, and is, therefore, much simpler and more compact, with lower cost.

In a specific example embodiment, sample gas can be admitted at about the same mass flow rate as for a closed source system (e.g., approximately 5E-4 Torr-liters/second), and the vacuum chamber pressure may be less than 2E-5 Torr. The pressure of the sample gas at, for example one millimeter, from the tip of the nozzle may be about three millitorr (typically between 0.1 and 30 millitorr), dropping as it expands away from the nozzle. Electron emission can be collimated into a focused beam, so that a much larger share of the current is engaged in useful ionization and primarily at the point of relatively high sample gas pressure near the nozzle. The pressure of the expanding gas at the center of the ionization region can be at least 5E-5 Torr, and the pressure of the gas when it reaches a critical surface can be at most 20% of that pressure. A typical mass filter (e.g., quadrupole), detector, and electronics can be used. In some embodiments, the active surfaces can be controlled independently to permit optimizing the tuning of the ion source to extend its operating life with respect to long-term contamination. To provide a relatively high local pressure in the ionization region with a total gas flow that can be accommodated by commonly available small turbomolecular vacuum pumps used to provide ionizer evacuation (typically less than 1E-2 Torr-liters/second), the gas emitter aperture (nozzle) can have an area less than five square millimeters, for example, with smaller values corresponding to high nozzle gas pressures. To minimize sample gas pressure throughout the ionizer, the sample gas stream can be directed toward the vacuum pump used for ionizer evacuation. To achieve useful operating life extension when sampling contaminating gases, the distances from the center of the gas nozzle to the nearest points of the electrode (or other) surfaces can be at least five millimeters, for example. To provide improved ionization of sample gas versus residual background gases, the cross sectional area of the electron beam can be well aligned between the apertures of the electrodes and be less than five times the area of the gas nozzle. To provide improved performance from the lowest pressure of sample gas from the gas source, the flow conductance of the gas path in the gas source can be greater than that of the area of the gas nozzle. To permit optimizing performance over the maximum operating life when sampling contaminating gases, the voltages on the electrodes may be independently and dynamically controllable, though improved performance relative to a closed ion source can usually be achieved with some of the electrodes being electrically preset and/or in common.

While this invention has been particularly shown and described with references to example embodiments thereof, it will be understood by those skilled in the art that various changes in form and details may be made therein without departing from the scope of the embodiments encompassed by the appended claims. For example, the gas source may take different forms from that disclosed herein, and the nozzle may be of different shapes or dimensions than shown and described herein. The electron source may be any suitable electron source for generating electrons to travel though the ionization region containing freely expanding sample gas close to the nozzle. The electrodes may be of a different number, shape, or arrangement than shown and described herein, so long as the electrodes are largely out of the path of the expanding sample gas and direct the ions formed in the ionization region to a mass filter component. It will be understood by those skilled in the art that dimensions, areas, flows, and pressures of the various components can be outside the specific example ranges provided herein, and can depend on the particular application of the ion source.

What is claimed is:

1. An ion source for a mass spectrometer having a mass filter, the ion source comprising:

a gas source to deliver gas to an evacuated ionization volume, the gas source being at a substantially higher pressure than that of the evacuated ionization volume;

a nozzle between the gas source and the ionization volume, gas passing through the nozzle freely expanding in an ionization region of the ionization volume;

an electron source configured to emit electrons, the electrons passing within five millimeters from the nozzle through the expanding gas in the ionization region to ionize at least a portion of the expanding gas; and electrodes configured to create electrical fields for ion flow of the ionized gas from the ionization region to the mass filter, the electrodes being located at distances from the nozzle and oriented to limit direct exposure of the electrodes to the gas.

2. The ion source of claim 1 wherein the nozzle is a small diameter tube.

3. The ion source of claim 1 wherein at least twenty percent of the gas molecules from the nozzle pass through the ionization region.

4. The ion source of claim 1 wherein the electron source is a heated filament.

5. The ion source of claim 1 wherein:

the electron source is arranged on an opposite side, with respect to the ionization region, of a first electrode; and electrons produced by the electron source travel through an aperture of the first electrode and toward the ionization region, resulting in an electron beam traveling through the expanding gas in the ionization region.

6. The ion source of claim 5 further including a second electrode arranged opposite the first electrode and including an aperture, wherein the electrons produced by the electron source travel through the aperture of the second electrode.

7. The ion source of claim 5 further including a trap electrode arranged opposite the first electrode with respect to the ionization region.

8. The ion source of claim 1 wherein the electrodes include first and second electrodes arranged on opposite sides of the ionization region, the surfaces of the first and second electrodes being substantially parallel to a primary direction of gas flow from the nozzle through the ionization region.

9. The ion source of claim 8 further comprising a repelling electrode configured to repel ions from the ionization region toward the mass filter.

10. The ion source of claim 8 further comprising an ion exit electrode having an aperture to direct the ion flow from the ionization region to the mass filter.

11. The ion source of claim 1 wherein:

the electrodes include:

first and second electrodes arranged on opposite sides of the ionization region, the surfaces of the first and second electrodes being substantially parallel to a primary direction of gas flow from the nozzle through the ionization region;

a trap electrode arranged opposite the first electrode and outside the second electrode with respect to the ionization region;

a repelling electrode configured to repel ions from the ionization region toward the mass filter; and an ion exit electrode having an aperture to direct the ion flow from the ionization region to the mass filter;

the electron source includes a filament arranged on an opposite side, with respect to the ionization region, of the first electrode; and electrons produced by the filament travel through an aperture of the first electrode, toward the ionization region, and through an aperture of the second electrode, resulting in an electron beam traveling between the first and second electrodes and through the expanding gas in the ionization region.

12. The ion source of claim 11 wherein voltages of the electrodes are independently controllable.

13. The ion source of claim 1 wherein an outlet opening of the nozzle has an area of less than five square millimeters, a cross-sectional area of the emitted electrons in the ionization region is less than five times the area of the outlet opening of the nozzle, and the electrodes are located at least five millimeters from the nozzle center.

14. The ion source of claim 1 wherein the ion flow of the ionized gas from the ionization region to the mass filter is in a direction that is offset from a primary direction of gas flow from the nozzle.

15. A mass spectrometer system comprising:

a vacuum pump;

a mass filter;

a detector; and an ion source including:

a gas source to deliver gas to an evacuated ionization volume, the gas source being at a substantially higher pressure than that of the evacuated ionization volume;

a nozzle between the gas source and the ionization volume, gas passing through the nozzle freely expanding in an ionization region of the ionization volume;

an electron source configured to emit electrons, the electrons passing within five millimeters from the nozzle through the expanding gas in the ionization region to ionize at least a portion of the expanding gas; and electrodes configured to create electrical fields for ion flow of the ionized gas from the ionization region to the mass filter, the electrodes being located at distances from the nozzle and oriented to limit direct exposure of the electrodes to the gas.

16. The mass spectrometer system of claim 15 wherein the nozzle is configured to direct the gas toward the vacuum pump.

17. The mass spectrometer system of claim 15 wherein the electron source is a heated filament.

18. The mass spectrometer system of claim 15 wherein:

the electron source is arranged on an opposite side, with respect to the ionization region, of a first electrode;

electrons produced by the electron source traveling through an aperture of the first electrode and toward the ionization region, resulting in an electron beam traveling through the expanding gas in the ionization region; and a second electrode is arranged opposite the first electrode and includes an aperture, the electrons traveling through the ionization region and the aperture of the second electrode.

19. The mass spectrometer system of claim 15 wherein the electrodes include first and second electrodes arranged on opposite sides of the ionization region, the surfaces of the first and second electrodes being substantially parallel to a primary direction of gas flow from the nozzle through the ionization region.

20. The mass spectrometer system of claim 19 further comprising a repelling electrode configured to repel ions from the ionization region toward the mass filter.

21. The mass spectrometer system of claim 19 further comprising an ion exit electrode having an aperture to direct the ion flow from the ionization region to the mass filter.

22. The mass spectrometer system of claim 15 wherein:

the electrodes include:

first and second electrodes arranged on opposite sides of the ionization region, the surfaces of the first and second electrodes being substantially parallel to a primary direction of gas flow from the nozzle through the ionization region;

a trap electrode arranged opposite the first electrode and outside the second electrode with respect to the ionization region;

a repelling electrode configured to repel ions from the ionization region toward the mass filter; and an ion exit electrode having an aperture to direct the ion flow from the ionization region to the mass filter;

the electron source includes a filament arranged on an opposite side, with respect to the ionization region, of the first electrode; and electrons produced by the filament travel through an aperture of the first electrode, toward the ionization region, and through an aperture of the second electrode, resulting in an electron beam traveling between the first and second electrodes and through the expanding gas in the ionization region.

23. The mass spectrometer system of claim 22 wherein voltages of the electrodes are independently controllable.

24. The mass spectrometer system of claim 15 wherein the ion flow of the ionized gas from the ionization region to the mass filter is in a direction that is offset from a primary direction of gas flow from the nozzle.

25. A method of producing ions for a mass spectrometer having a mass filter, the method comprising:

delivering gas from a gas source to an evacuated ionization volume through a nozzle, the gas source being at a substantially higher pressure than that of the evacuated ionization volume, gas passing through nozzle freely expanding in an ionization region of the ionization volume;

emitting electrons, the electrons passing within five millimeters from the nozzle through the expanding gas in the ionization region to ionize at least a portion of the expanding gas; and directing ions of the ionized gas formed in the ionization region to the mass filter.

26. The method of claim 25 wherein directing the ions includes directing the ions using electric fields created by electrodes, and wherein delivering the gas to the evacuated ionization volume includes delivering the gas at distances from electrodes to limit direct exposure of the electrodes to the gas.

27. The method of claim 25 wherein emitting electrons includes emitting electrons from a heated filament.

28. The method of claim 25 wherein emitting electrons includes emitting electrons through an aperture of a first electrode and through the expanding gas in the ionization region.

29. The method of claim 28 wherein emitting electrons includes emitting electrons through an aperture of a second electrode on an opposite side of the ionization region.

30. The method of claim 25 wherein directing the ions includes repelling the ions from the ionization region toward the mass filter.

31. The method of claim 25 wherein directing the ions includes focusing the ions from the ionization region through an aperture to the mass filter.

32. The method of claim 25 wherein directing the ions of the ionized gas includes directing the ions in a direction that is offset from a primary direction of gas flow from the nozzle.

33. An ion source for a mass spectrometer having a mass filter, the ion source comprising:

a gas source to deliver gas to an evacuated ionization volume, the gas source being at a substantially higher pressure than that of the evacuated ionization volume;

a nozzle between the gas source and the ionization volume, gas passing through the nozzle freely expanding in an ionization region of the ionization volume;

an electron source configured to emit electrons, the electrons passing close to the nozzle through the expanding gas in the ionization region to ionize at least a portion of the expanding gas; and electrodes configured to create electrical fields for ion flow of the ionized gas from the ionization region to the mass filter, the electrodes being located at distances from the nozzle and oriented to limit direct exposure of the electrodes to the gas;

wherein an outlet opening of the nozzle has an area of less than five square millimeters, a cross-sectional area of the emitted electrons in the ionization region is less than five times the area of the outlet opening of the nozzle, and the electrodes are located at least five millimeters from the nozzle center.

* * * * *